United States Patent [19]

Schaeffer

[11] 3,958,691

[45] May 25, 1976

[54] HANGER CARTRIDGE FOR FACILITATING ASSEMBLY OF TRAVERSE RODS

[75] Inventor: Bruce W. Schaeffer, St. Joseph, Mich.

[73] Assignee: Kirsch Company, Sturgis, Mich.

[22] Filed: Dec. 26, 1974

[21] Appl. No.: 536,576

[52] U.S. Cl. ..... 206/326; 211/7; 211/162

[51] Int. Cl.[2] ..... B65D 85/00

[58] Field of Search ..... 206/279, 289–291, 206/298, 300, 326, 341, 346, 382–383, 443, 486, 488, 526; 211/4, 7, 113, 123–124, 162; 248/340

[56] References Cited

UNITED STATES PATENTS

| | | | |
|---|---|---|---|
| 1,291,810 | 1/1919 | Elliott | 206/341 |
| 1,295,141 | 2/1919 | Elliott | 206/346 |
| 2,098,420 | 11/1937 | Jackson | 206/340 |
| 2,317,531 | 4/1943 | Hudson et al. | 206/326 |
| 2,710,484 | 6/1955 | McGinnis | 211/124 X |
| 2,966,695 | 1/1961 | Dwyer | 206/498 UX |
| 3,396,834 | 8/1968 | Luckey et al. | 206/326 |
| 3,489,288 | 1/1970 | McDaniel | 211/7 |
| 3,854,591 | 12/1974 | Schvessler | 211/123 |

*Primary Examiner*—Steven E. Lipman
*Attorney, Agent, or Firm*—Woodhams, Blanchard and Flynn

[57] ABSTRACT

Cartridge system for facilitating the insertion of hangers into a traverse rod. For the rapid and inexpensive assembly of traverse rods, a cartridge arrangement is provided for groups of hangers whereby such groups may be rapidly and inexpensively inserted in predetermined numbers into a traverse rod. The carrier portion of the cartridge may be removed immediately from said hangers or, if desired, it may be left in place to hold the hangers against movement relative to each other during shipment and may then be quickly and easily removed by the installer or other purchaser at any time following shipment. Said cartridge comprises a plurality of hangers, each having a depending pendant and an elongated carrier member having successive perforations therein for receiving the pendants of such plurality of hangers. The relationship of the elongated member, hangers and pendants and the traverse rod are all such that the presence of the elongated member does not interfere with the insertion of the hangers into the traverse rod and hence same may be inserted in groups with the elongated carrier member in place and the latter then removed as and when convenient.

13 Claims, 9 Drawing Figures

FIG. 1
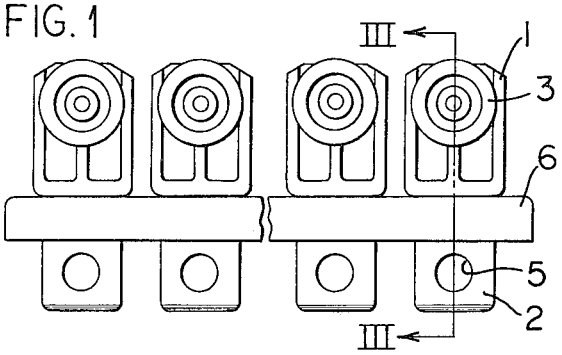
FIG. 2
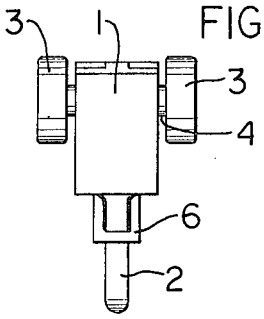
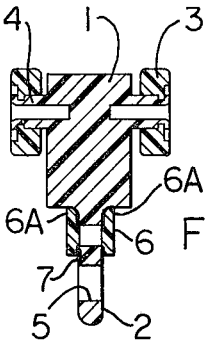
FIG. 3
FIG. 4
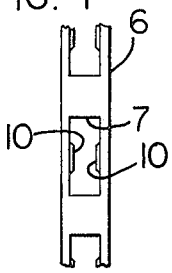
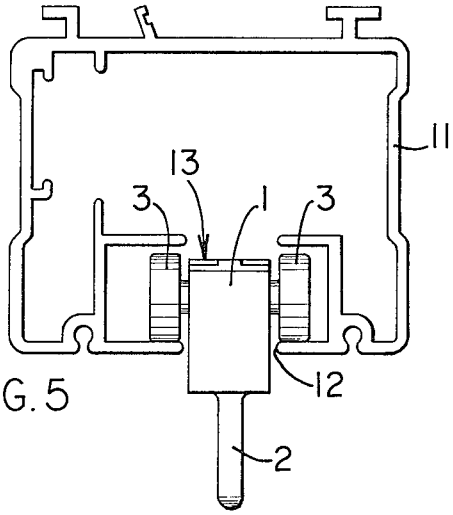
FIG. 5
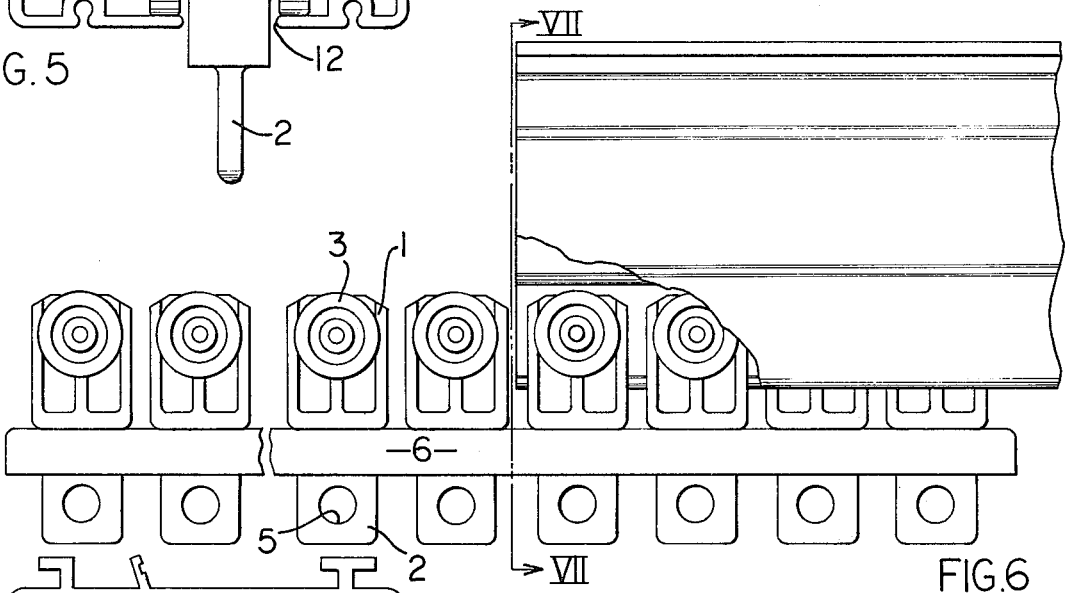
FIG. 6
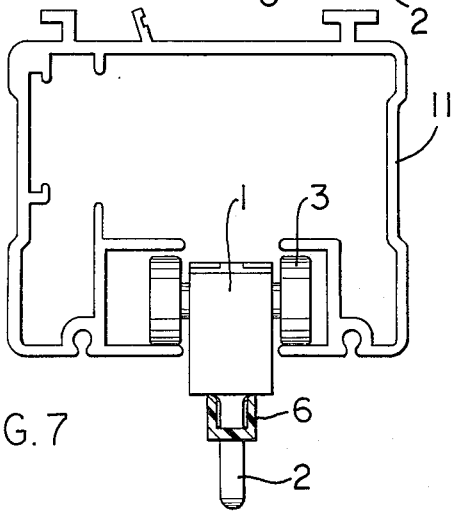
FIG. 7
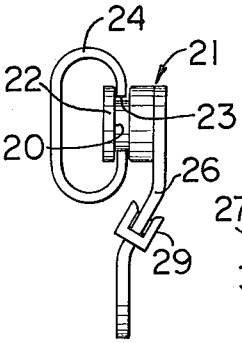
FIG. 8
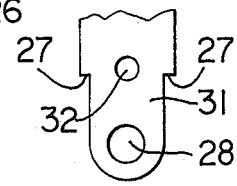
FIG. 9

HANGER CARTRIDGE FOR FACILITATING ASSEMBLY OF TRAVERSE RODS

FIELD OF THE INVENTION

The invention relates to traverse rod construction and relates particularly to an interrelated traverse rod and hanger construction together with a retaining or carrier member for holding a plurality of hangers in a predetermined relationship with each other whereby a group of said hangers may be conveniently and quickly inserted into the traverse rod in operative position therein and said retainer removed at such subsequent time as is convenient.

BACKGROUND OF THE INVENTION

In the construction of traverse rod assemblies, a continuing problem for many years has been in the hand labor required for assembling the various components and particularly for assembling the sliders or hangers into the rod unit. The problem exists and has existed both in the factory assembly of pre-cut traverse rods as well as in the workroom assembly of cut-to-measure traverse rods. This has required both hand manipulation to insert the hangers individually into the traverse rod and accurate counting thereof by the workman to make sure that the proper number of hangers is inserted into a given traverse rod. Since the number of such hangers will vary with the length of the traverse rod, this is a frequent source of error in both types of assembly procedures with consequent customer irritation.

This problem has long been recognized and various solutions have been offered for it. One such solution has been to mold a plurality of hangers in a single piece with a small connecting web therebetween in order that such hangers could be handled as a single piece. However, this requires breaking apart of such hangers after they are installed into the traverse rod and this is not only inconvenient and time consuming but is sometimes not carried out completely, again resulting in customer irritation. Many hangers and/or traverse rods associated therewith are not, because of their construction, adaptable to the arrangement of hangers in preassembled groups and, hence, for the majority of presently known designs of traverse rods and hangers for same, the problem above outlined continues to exist with the consequent disadvantages as mentioned above.

Accordingly, the principal objects of the invention include:

1. To provide a cooperative traverse rod hanger and retainer design for enabling groups of hangers to be held by a simple retainer and capable while being so held of being inserted by virtually a single motion into operative position within a traverse rod with the retainer being then quickly and easily removable at any desired subsequent time.

2. To provide an arrangement, as aforesaid, wherein said retainer is sufficiently inexpensive as to constitute a throwaway item when removed.

3. To provide an arrangement, as aforesaid, in which said retainer is of sufficiently simple and inexpensive construction that it need not be removed following insertion of the hangers into the traverse rod but instead may remain in position until removed by the purchaser.

4. To provide apparatus, as aforesaid, in which said retainer is a simple molded strip with openings provided therein.

5. To provide an arrangement, as aforesaid, in which said retainer, following insertion of the hangers into the traverse rod, remains outside of the traverse rod and is accordingly removable from the hangers by a simple short motion thereof in a direction away from the traverse rod.

Other objects and purposes of the invention will be apparent to persons acquainted with apparatus of this type upon reading the following specification and inspection of the accompanying drawings.

BRIEF DESCRIPTION OF THE DRAWINGS

In the drawings:

FIG. 1 shows a plurality of hangers assembled into a retainer according to the invention.

FIG. 2 is an end view from the rightward end of FIG. 1.

FIG. 3 is a section taken on the line III—III of FIG. 1.

FIG. 4 is a fragmentary view of a retainer from the bottom thereof.

FIG. 5 is an end view of a traverse rod with hangers inserted therein.

FIG. 6 is a broken end fragmentary side view of a traverse rod with a cartridge of hangers partially inserted therein.

FIG. 7 is a sectional view on the line VII—VII of FIG. 6.

FIG. 8 is an end view of the invention utilizing a different type of hanger.

FIG. 9 is a fragmentary front view of the pendant portion of the hanger in FIG. 8.

DETAILED DESCRIPTION

Referring first to FIGS. 1, 2 and 3, there is shown a plurality of hangers together with a retainer comprising a hanger cartridge embodying the invention. The hangers, which may vary widely within the scope of the invention, here each comprise a block or head portion 1 which will normally be made with a series of recesses therein for the normal plastic molding design purposes of efficient mold design and minimizing the use of plastic material. From said block portion 1 there extends a pendant 2 which in this embodiment is of generally rectangular form and substantially narrower and thinner than the block portion 1. Drapery retaining means, in this instance openings 5 for the reception of drapery hooks, are supplied at the lower end of the pendant 2. Rollers 3 are pivotally mounted to axles 4 which project laterally from both sides of the block portion 1. Said axles are normally molded integrally with the block portion 1 and the rollers separately molded and subsequently applied thereto by any desirable presently known technique.

The retainer 6 is of relatively narrow elongated construction, in this embodiment same being of extrudable, channel-shaped contour. The web of the channel is provided with a plurality of spaced openings 7 for the reception therethrough of the pendants 2 of each of the several hangers. Alternatively, and in some cases preferably, said retainer 6 will be injection molded in order that said openings 7 may be directly molded therein.

Said opening 7 (FIG. 4) is of such dimensions, in both lengthwise and widthwise directions, that it receives the pendant 2 snugly therein whereby to provide a snug but nevertheless readily sliding fit between said pendant and the edges of said opening. Thus, the pendants will be maintained against appreciable motion with respect to the retainer and, when said hangers are pushed down firmly so that the block portion 1 rests against the upper edges of the retainer flanges 6A, said retainer will be closely and snugly aligned therewith. Further, the fit between said pendant 2 and the sides of the openings 7 is preferably sufficiently snug that the cartridge can be turned upside down or otherwise handled without causing said hangers to separate from said retainer.

Further if desired for insuring a snug fit between said pendants 2 and the edges defining the opening 7, small projections 10, here on both sides of the openings 7, may be provided as shown in FIG. 4. Inasmuch as the openings 7 are almost but not entirely the full width of the inside surface of the web of the retainer, the flanges of said retainer adjacent said opening will spring outwardly slightly to permit the pendant 2 to pass the projections 10 and the resilience thereof will hold said projections snugly against said pendants.

While two such projections 10 have been shown and such is preferable, it will be recognized that the retainer will be operable if only one thereof is used.

Likewise to assure stability between the hangers and the retainer, it will be noted from FIGS. 2 and 3 that the flanges 6A of said retainer lie closely against the adjacent surfaces of the pendant 2 and the upper inside edges of said flanges 6A are rounded to lie snugly against the fillets which in normal molding design technique will be provided between said pendants and the bottom surface of the block 1.

The pendants 2 of said hangers may, of course, be inserted into said openings 7 by hand but it is preferable, and wholly possible within the scope of presently well understood techniques, to insert said pendants into said retainers 6 by automatic means which are preferably either associated with or immediately following the molding machine. The wheels may then be applied by any technique desired.

Alternatively, the wheels may be applied to the block portions 1 within or immediately following the molding machine and the hangers may still be inserted by presently known and available automatic means into said retainers 6 to form the cartridges of which one is shown in FIG. 1.

Referring now to FIG. 5 there is shown an end view of a typical traverse rod in which the hangers shown in FIGS. 1–3 are to be inserted, said figure showing said rod with a hanger in normal operative position therein. Said rod 11 has a bottom slot 12 therein. The hanger 13 is positioned with its rollers 3 on either side of said slot 12 and its head portion 1 extends downwardly through said slot. In this embodiment, said head portion 1 is of appropriate thickness, with respect to the width of the slot, to appropriately limit movement of the hanger laterally with respect to the traverse rod.

FIG. 6 shows a cartridge of hangers partially inserted into a traverse rod, and FIG. 7 shows a sectional view as taken on the line VII—VII of FIG. 6. It will be seen from these figures that the retainer, whose uppermost position is limited by the bottom of the head portion 1, remains at all times in a position below the traverse rod. Thus, said retainer in no way interferes with the entry into the traverse rod of the hangers, but it will be recognized that the holding of a plurality of hangers in a relatively fixed position with respect to each other by the retainer makes it possible to insert such plurality of hangers as a single group quickly and easily into the traverse rod.

When the cartridge is inserted into the rod, the hangers will resist movement directly downwardly and, hence, the retainer can be pulled off the pendants 2 by a single relatively short, simple downward movement thereof. Such removal of the retainer from the hangers may take place immediately after assembly or, if preferred, the assembled traverse rod may be shipped with said retainer in place and the retainer removed at any desired subsequent time by the recipient.

Inasmuch as the retainer is a simple channel-shaped part, it will require only a small amount of plastic material and is therefore sufficiently inexpensive that it may be shipped along with the traverse rod assembly and subsequently treated as a throw-away item, if desired.

FIGS. 8 and 9 show the application of the invention to a different type of hanger, namely, one designed for use in a traverse rod 24 having a side slot 23. Here, the hanger 21 is provided with a conventional head member 22 having an annular recess 20 for reception into the side slot 23 of the traverse rod 24. From said head member 22 there depends a pendant 26 preferably having edge shoulders 27 on either or both edges thereof and drapery retaining means, such as an opening 28 at the lower end thereof. A retainer 29 which is U-shaped in cross section and provided with successive openings therethrough, similar to the retainer 6 above described, receives the lower portions 31 of a plurality of said pendants into each of its said openings with the shoulder(s) resting against said retainer for both limiting the extent to which said pendant enters into said retainer and for stabilizing said pendant within said retainer.

If desired, secondary openings 32 may be provided in the portion 31 of the pendant 26 for the reception of projections corresponding to the projections 10 of FIG. 4, whereby further to lock the retainer 29 snugly but removably onto the pendant 26 for the formation of a convenient and easily handled cartridge.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A retainer for facilitating the insertion into a slotted traverse rod of a plurality of hangers, each said hanger having a head portion and pendant means depending from said head portion, said retainer comprising:

an elongated member having a plurality of openings therethrough, each of said openings being sized to receive snugly but slidably therein the pendant portion of one of said hangers, said elongated member being generally channel-shaped and comprising a web flanked by flanges, said openings being positioned through the web of said channel;

said openings being substantially the full width of the space between the flanges of said channel, said flanges at said opening being resilient and capable of being sprung outwardly, at least one side of said opening adjacent one of said flanges having a projection extending into said opening to an extent that a pendant projecting through said opening bears against said projection and distorts the adjacent side of said flanges sufficiently to develop a tension holding said projection firmly but slidably against said pendant and thereby holding said pendant snugly but removably in said opening.

2. A cartridge arrangement for facilitating the insertion of hangers into the slot of a slotted traverse rod, said cartridge arrangement comprising:

a plurality of hangers each having a head portion arranged for projecting through said slot, said head portion including means engageable with said traverse rod at least adjacent said slot for longitudinal travel of said hanger on said traverse rod, each of said hangers having means providing a downwardly facing surface positioned at least adjacent said head portion for location outside of said slot when said hanger is in operative position on the traverse rod, each hanger having a pendant portion projecting beyond said surface in a direction away from said head portion; and an elongated retainer having a plurality of openings therethrough, said openings receiving said pendant portions snugly but releasably therethrough with said retainer bearing against said downwardly directed surfaces of said hangers, said retainer being channel-shaped with the openings in the web of the channel, the flanges being resiliently deformable and including means lying closely against the opposed sides of said pendant portions for resilient gripping and retaining said hanger pendants snugly between said flanges, said hangers extending upwardly and downwardly beyond said flanges.

3. The device of claim 2, wherein each said hanger pendant portion is platelike and has an enlarged opening near the bottom thereof for receiving a drapery attaching element, said retainer member including at least one projection extending into each of said retainer member openings from the side thereof adjacent a said flange, and including a further opening in each pendant portion positioned in spaced relation above said enlarged opening, said projection entering releasably into said further pendant opening.

4. The apparatus of claim 2, in which said retainer member channel-shape opens toward said hanger head and the exterior surface of said retainer member web faces toward the free end of said pendant, said pendant being filleted at its joinder to said head, the upper edges of said retainer member flanges being rounded to conform substantially to and engage the surfaces of said fillets.

5. A cartridge arrangement for facilitating the insertion of hangers into the slot of a slotted traverse rod, said cartridge arrangement comprising:

a plurality of hangers each having a head portion arranged for projecting through said slot, said head portion including means engageable with said traverse rod at least adjacent said slot for longitudinal travel of said hanger on said traverse rod, each of said hangers having a downwardly facing surface positioned at least adjacent said head portion and locatable outside of said slot when said hanger is in operative position on the traverse rod, each hanger having a pendant portion projecting beyond said downwardly facing surface in a direction away from said head portion; and an elongated retainer having a plurality of openings therethrough, said openings receiving said pendant portions snugly but slidably therein as said retainer bears against the downwardly directed surfaces of said hangers, said retainer being channel-shaped with said openings being in the web of such channel, the flanges of such channel lying closely against the opposed sides of said pendant portions, at least one projection extending into each of said openings from the side thereof adjacent a flange, and interferring with the pendant portion in said opening, at least one said flange being distorted outwardly and tensioned and therewith urging said projection snugly against said pendant portion tightly but slidably within said retainer.

6. A traverse rod assembly system, comprising:

a substantially linear, elongated retainer member having a web and flange means extending continuously alongside the web, longitudinally spaced segments of said web being omitted and providing a series of openings through said web and transversely extending substantially the width thereof;

a plurality of drapery hangers each having a head and a reduced width pendant extending downward from said head, said hangers each including downwardly facing surfaces at least adjacent the underside of said head and flanking the side edges of said pendant, each said hanger pendant extending through and being releasably fixed in a corresponding said opening in said retainer member with said head of said hanger above said retainer member, said downwardly facing surfaces of said hangers bearing on opposed upwardly facing surfaces of said retainer member to align said heads in a row parallel to and above said retainer member, said hanger pendant being adjacent said retainer member flange means;

an elongate traverse rod having a longitudinal slot means for receiving and longitudinally movably securing said hanger heads and along which slot means said retainer member is axially movable, said slot means including opening means responsive to movement of said retainer member alongside said traverse rod for loading the heads of said hangers carried by said retainer member into said slot means without contact of said traverse rod by said member, said retainer member being held spaced from and substantially parallel to said traverse rod by ones of said hangers simultaneously engaging said retainer member and traverse rod, the securement of said hanger pendants to said retainer member being released by pulling said retainer member transversely away from said traverse rod when said hangers are loaded on such traverse rod.

7. The apparatus of claim 6, in which said retainer member includes a projection extending partially into said opening and engaging the opposed side of the hanger pendant for resiliently securing the hanger to the retainer member in a tight but removable manner.

8. The apparatus of claim 6 in which, said flange means comprises a substantially parallel pair of flanges separated by said web, the portions of said flanges adjacent said opening being resiliently deformable away from each other, said hanger pendant being snugly disposed between said flanges, said hanger head being disposed above said flanges.

9. The apparatus of claim 8, in which said retainer member includes a projection extending inwardly beyond the inside surface of at least one flange of said retainer member, said projection being disposed intermediate the longitudinal ends of a corresponding said opening in said retainer member, said flanges of said retainer member adjacent said opening being resiliently deformable outwardly from each other to permit insertion of the pendant of the corresponding hanger through said opening past said projection, the resilience of said flanges holding said projection snugly against said pendant to prevent unintended falling of said hanger from said retainer member.

10. The apparatus of claim 9, including a pair of said projections opposed and spaced apart transversely of said retainer member and occupying a minor central portion of the area of a said opening in said web, said hanger pendant being substantially platelike and having an opening therethrough, said projections extending partly into said pendant opening to releasably lock said retainer member to said traverse rod through said hangers

11. The apparatus of claim 8, in which said hanger head comprises a blocklike member having rollers rotatably mounted on opposite sides thereof, said slot of said traverse rod opening downwardly, said traverse rod having interior faces bounding said slot for supporting said rollers, said hanger head extending downward through and below said slot, said downwardly facing surfaces being the bottom surfaces of said head between which said pendant is fixed to said head, said head bottom surfaces being supported on the upper edges of said retainer member over a distance substantially corresponding to the longitudinal extent of said head.

12. The apparatus of claim 8, in which said slot opens sidewardly of said traverse rod, said hanger head engaging said slot and having a portion outside said traverse rod, said pendant extending downward from said head portion, said downwardly facing surfaces of said hanger being downwardly facing steps intermediate the ends of said pendant, said pendant engaging the web of said retainer member at longitudinally opposite ends of said web opening, said flanges extending above said steps to sandwich therebetween the wider upper portion of said pendant.

13. The apparatus of claim 8, in which said retainer member extends along said traverse rod in transversely spaced relation thereto and is removably affixed thereto by said hangers such that the traverse rod, hangers and retainer member comprise a unit for shipping, mutual engagement of said hangers with said traverse rod and retainer member preventing loss of an individual one or ones of said hangers from said traverse rod.

* * * * *